United States Patent [19]

Sieverding

[11] Patent Number: 4,474,313

[45] Date of Patent: Oct. 2, 1984

[54] DISPENSER FOR PASTY SUBSTANCES

[75] Inventor: Werner Sieverding, Lohne, Fed. Rep. of Germany

[73] Assignee: Bramlage GmbH, Lohne, Fed. Rep. of Germany

[21] Appl. No.: 318,723

[22] Filed: Nov. 6, 1981

[30] Foreign Application Priority Data

Nov. 8, 1980 [DE] Fed. Rep. of Germany ..... 3042285

[51] Int. Cl.[3] ..... B65D 37/00

[52] U.S. Cl. ..... 222/211; 222/386; 222/405; 222/464

[58] Field of Search ..... 222/206, 207, 211, 213, 222/386, 387, 389, 405, 406, 464, 215

[56] References Cited

U.S. PATENT DOCUMENTS 2,679,337 5/1954 Leach ..... 222/211 X
2,789,337 4/1957 Biederman ..... 222/211 X
3,088,636 5/1963 Spatz ..... 222/387 X
3,870,200 3/1975 Spatz ..... 222/206
4,087,024 5/1978 Martin et al. ..... 222/211

FOREIGN PATENT DOCUMENTS 1210149 2/1966 Fed. Rep. of Germany .

*Primary Examiner*—Joseph J. Rolla
*Assistant Examiner*—Michael S. Huppert
*Attorney, Agent, or Firm*—Martin A. Farber

[57] ABSTRACT

A dispenser for pasty substances with a housing having a piston displaceable only in a discharging direction and an outer operating handle which is formed at a head-piece, compressible in a bellows-like manner in the direction of the piston, which headpiece has a dispenser-outlet opening. A tubule with an inner open end in every position of the bellows immersed in the pasty substance, extends inwardly from the dispenser-outlet opening.

15 Claims, 3 Drawing Figures

DISPENSER FOR PASTY SUBSTANCES

Figure 2:
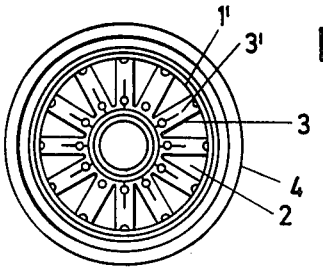

The invention relates to a dispenser for pasty substances with a housing having a piston displaceable only in a discharge direction and an outer operating handle which is formed at a headpiece, compressible in a bellows-like manner in the direction of the piston, the head-piece having a dispenser-outlet opening.

A dispenser of this type is known from German As No. 1,210,149. There, the piston is drawn by the vacuum, which forms in the housing with each restoring action of the headpiece bellows, over the filling column in the direction of the headpiece. In order not to lose this function by entry of air leakage via the dispenser-outlet opening, a valve is mounted in the latter which momentarily closes the opening again upon the dropping of overpressure (pressure above atmospheric pressure). The coordination of a corresponding dispensing valve is too expensive for a mass produced article as, for example, a toothpaste-dispenser package. Moreover, operating breakdowns are to be expected since the headpiece bellows, which is formed from correspondingly softened material and thus considerably variable in shape, does not exclude shifting of the spring means. Since, ultimately, the outlet valve is suddenly opened by a predetermined overpressure threshold, undesirable spray effects and, in any event, inexactly proportionable discharging amounts can result. Finally, there is also the disadvantage of a considerable expenditure for assembling and components.

It is the object of the invention to create a dispenser of this type, with a structure which is technically simpler to manufacture and more advantageous to use, in such a way that the noted discharge valve can be eliminated.

This object is solved by a tubule (7), immersed, with an inner always open mouth end (7″) being completely free, in every position of the bellows (B), in the pasty substance (M), extending inwardly from the dispenser-outlet opening(O).

As a result of such a design, a dispenser of this type is created which is satisfactory without any separate valve, however, still allowing an exactly proportionable, convenient to operate dispensing. The valve function, still attainable surprisingly with use of the inertia of the pasty substance, is also more advantageous in that an overpressure (pressure above atmospheric) for opening the valve, no longer has to first be produced, which overpressure always caused a more or less sudden, inadequately controllable discharging of the contents. In a structurally simple manner with the present invention, a tubule extends from the dispenser-outlet opening which tubule remains immersed in the pasty substance with its inner open mouth end in every position of the bellows with the inner always open, mouth end of the tubule being completely exposed communicating with the pasty substance in the housing. The factors such as tubule cross-section, length and viscosity of the pasty substance are adjusted or balanced in such a way that the retraction of the piston occurs first, that is, before the pasty substance remaining in the tubule, which as a plug obstructs the tubule from communication with the outside air, can equalize the resulting vacuum with air. The structural design of the dispenser is also considerably simplified. Such a tubule can be attached directly to or formed in one-piece on the headpiece. A separate construction is, however, recommended when substances of differing viscosity and other characteristics are involved, so that by keeping the basic structure, comprising the housing, clamp-locked piston and headpiece, it is then equipped, as required, with the cross-sectionally adapted tubule. A formation, practically itself bringing about the operationally correct useage, exists when the tubule extends inclined at an acute-angle relative to the longitudinal axis of the tubular housing. This, above all, brings a desired, exact alignment of the tubule with respect to the discharge position as, for example, for the bristles part of a toothbrush. Thereby, the inner open end of the correspondingly coordinated tubule extends into the area of the longitudinal center axis of the housing, that is, into a central area which is convenient or favorable for pressing. If, finally, the bellows and its folding zone are formed in such a way that the tubule tilts, during bellows operation, an approximately coaxial position relative to the longitudinal center axis of the housing, then the considerable operational advantage results that the dispensing-sided tubule end practically retracts from the projecting paste extrusion. This facilitates the application of this paste extrusion, which can also be exactly followed visually, onto the toothbrush.

Figure 1:
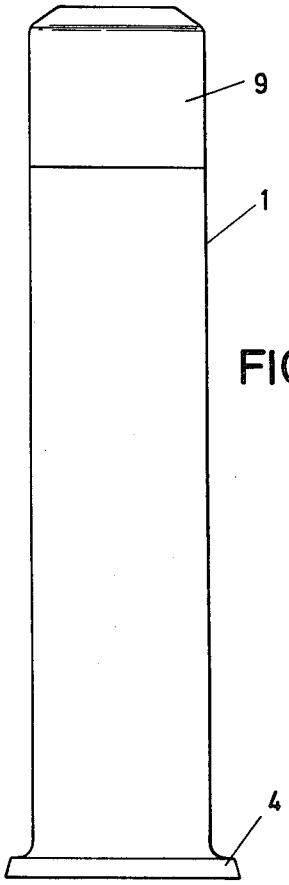
Figure 3:
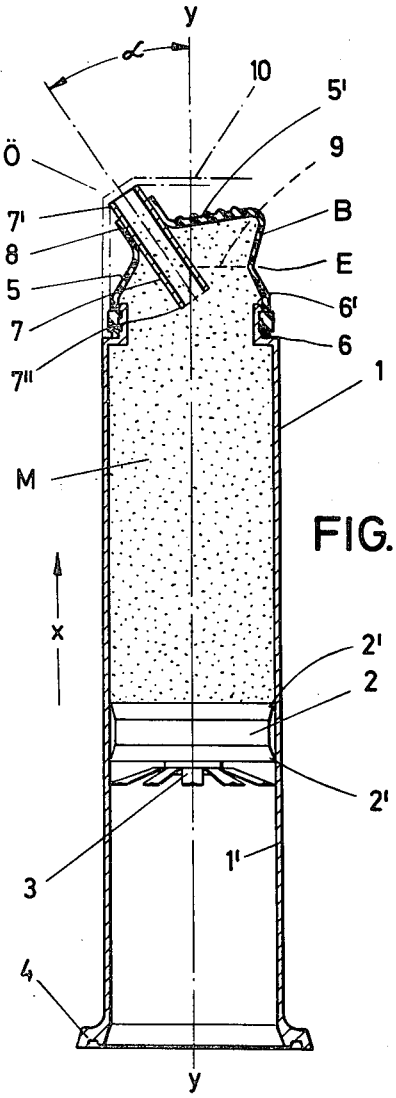

With the above and other objects and advantages in view, the present invention will become more clearly understood in connection with the detailed description of a preferred embodiment, when considered with the accompanying drawing, of which:

FIG. 1 shows a dispenser formed in accordance with the invention, in side view, FIG. 2 is a base view thereof FIG. 3 is a longitudinal section through the dispenser with closure cap indicated in dash-dotted lines.

The long cylindrical housing 1 contains a piston 2. Its peripheral lips 2′ run along the cylindrical inner side of housing wall 1′. The housing 1 is open at the bottom.

The piston 2 is only displaceable in the discharging direction (arrow x). On its wide surface, facing the assembly-sided open end of the housing, it carries a so-called clamp module 3 in the shape of a star, made of spring steel, having substantially radially directed prongs 3′. Its diameter circumscribing the prongs in the free non-inserted position is larger than the open diameter of the housing, whereby the prong ends as inclined support feet blockingly engage on the inner housing wall opposite to the direction of the arrow x preventing the piston 2 from moving down.

The dispensing-side closure of the housing 1 forms an operating or actuation handle mounted opposite the standing base 4 of the same. It is a headpiece 5, compressible in a bellows-like manner in the direction of the piston 2, always returning spontaneously straightening again into its initial position. The latter headpiece 5 is attached to the slightly narrowed neck 6 of the housing 1. By means of a ring-groove connection in cooperation with the restoring force of the material forming the headpiece 5, there is provided a useable durable fastening.

The headpiece 5 forms a cross-sectionally narrowed dispenser outlet opening Ö. A tubule 7 projects into the interior of the dome-like shaped headpiece 5 from the opening Ö. The tubule is made of relatively stiff material and is held by a protrusion 8 extending and formed from the headpiece cover 5′ and pointing diagonally upward. The tubule is seated therein in a clamp mounting, but can, however, if required, be connected to the headpiece by glue or even welding.

Equally possible is a one-piece formation of the tubule 7 with the headpiece 5. The tubule 7 is inclined at an acute-angle to the longitudinal axis y—y of the tubular or cylindrical housing 1. In this manner, it projects with its outer open end 7', forming the outlet Ö, almost into the area of an extended casing level of the housing 1. The inner open end 7'' extends into the vicinity of the longitudinal center axis y—y, that is, into the center of the axially symmetric housing. It ends about level with the upper edge 6' of the neck and penetrates, as seen in FIG. 3, with this inner open end 7'' into the pasty substance M, which comes up to under the dome-shaped cover 5' of the headpiece 5, that is, the pasty substance also entirely surrounds the tubule. Moreover, a portion of the tubule 7 is always filled with the pasty substance. The angle of inclination alpha of the tubule 7 relative to the axis y—y is approximately 30°.

The zone forming the bellows B of the headpiece 5 is obtained by a horizontal flat-V-shaped constriction E. This constriction extends over half the cross-sectional width of the headpiece 5 which tapers frustoconically upward in its basic form. The furrow of the bellows is indicated with the numeral 9 and illustrated in FIG. 3 with a dashed line.

The acute-angled coordination of the tubule 7 in the section of the headpiece 5, opposite the constriction E, is such that the tubule 7 tips, by the bellows operation, so as to orient itself in a coaxial or approximately coaxial or spacial parallel position relative to the longitudinal center axis y—y of the housing 1. In this manner, the outer open end 7' of the tubule 7 moves away from its usual position near the edge. The open end 7' can also be shaped in a more beak-shaped curved form in such a way that the opening Ö is perpendicular to the axis y—y.

The headpiece 5 is encased by a cap 10 shown partially in dot-dashed lines in FIG. 3. The inner corner of the cap cover is tapered corresponding to the front surface position of the tubule, so that with the tapered cap 10 in position the tubule opening is tightly sealed. The cap 10 is held frictionally or locked in position by a complementary shaping of the parts at a peripheral bead in the fastening area of the same between the lower headpiece edge and the neck 6 of the housing 1.

The manner of operation of the described dispenser is as follows: After removal of cap 10, the headpiece 5 is pressed downwardly in the direction of the piston 2 in the area forming the bellows B, which area is grooved like a tire or otherwise roughened on the upper side. The piston 2 is supported by the clamp module 3, so that it cannot move or deviate downwardly. The pasty substance M is pressed, while passing through the tubule 7, in direction of the opening Ö and finally discharges from the open end 7'. If the headpiece 5 is now released, vacuum pressure develops in the housing interior. The flexible headpiece 5, returning to its initial position, retracts or pulls the piston up in the direction of the arrow x over the contents column. This resetting is completed before the substance still remaining in the tubule as a plug can reach the inner open end 7''. Decisive thereby is that the tubule 7, in cross-section and length, with adjustment to the viscosity of the pasty substance and the resultant flow velocity, forms a corresponding resistance which bridges the vacuum which occurs.

The ratio of the open tubule cross-section to the tubule length is approximately 1:5.

| Pressure ratios in the Dispenser (hydraulic system) | |
|---|---|
| Explanation of symbols: | λ = coefficient of friction for flowing mediums<br>l = tubule length<br>d = open tubule width<br>R = Reynolds' Number;<br>R < 2000 (laminar)<br>R > 3000 (turbulent)<br>V = average velocity of substance<br>ρ = density of substance |

The table of pressure ratios in the dispenser is reproduced on the following page.

Table of Pressure Ratios in the Dispenser $$\Delta P_{Piston\ friction} + \Delta P_{Piston\ acceleration} + \Delta P_{Substance\ friction} + \Delta P_{Substance\ acceleration} \leqq \underbrace{\Delta P_{Substance\ friction\ (tubule)} + \Delta P_{Substance\ acceleration\ (tubule)}}_{\text{Low Pressure } P'_{eff}}$$

With slow release of the dosing head (standstill of the piston) the following applies:

$$P_{eff} = \Delta P_{RR} + \Delta P_{aR}$$

$$P_{eff} = \lambda \times \frac{l}{d} \times \frac{\rho}{2} \times V^2 + \rho \times \frac{V^2}{2}$$

$$\Delta P_{RR} = \times \frac{l}{d} \times \frac{\rho}{2} \times V^2$$ Pressure loss through tube friction $$\Delta P_{aR} = \rho \times \frac{V^2}{2}$$ Pressure loss through inertia $$\lambda = \frac{64}{R} \qquad R = \frac{V \times d}{\nu}$$ Viscosity

I claim:

1. A dispenser in combination with and adapted for particular pasty substances comprising a tubular housing containing a particular pasty substance and defining a longitudinal axis, a piston mounted in said housing displaceably only in one direction constituting a discharging direction, a headpiece mounted on said housing, formed as a bellows and having an outer operating handle which is formed at said headpiece, the latter having a folding-bellows cover being compressible in a bellows-like manner in a direction of the piston, the headpiece having an interior wall including an interior side of said cover, a tubule is arranged in said cover and extends inclined at an acute-angle relative to the longitudinal axis of the tubular housing through said headpiece defining an inner section therein which over its entire length projects inwardly inside the bellows into the housing and terminates at an innermost end, said tubule has a dispenser-outlet opening at an outer end of the tubule and extends inwardly therefrom to said innermost end, the latter being formed with an inner open mouth end formed so as to be always completely openly exposed penetrating in and communicating the tubule with said pasty substance in said housing and headpiece in every position of the bellows, said tubule constituting the exclusive means of the dispenser for communicating the interior of said housing with the outside, said particular pasty substance completely fills the interior of said housing above said piston and above said innermost end of said tubule, surrounding said inner section of said tubule, to said interior wall of said headpiece and extends continuously through the always communicating openly exposed inner open mouth end into said tubule through said entire length of said inner section forming a pasty substance plug continuously connected to said pasty substance in said housing and headpiece, said inner section of said tubule and said inner open mouth end penetrating substantially deeply into the pasty substance in the interior of said housing and headpiece, said tubule, said piston and said housing being formed relative the particular pasty substance such that resistance against displacement in said one direction of the piston in said housing is smaller than resistance against displacement of the particular pasty substance in the tubule when said bellows is released after being compressed.

2. The dispenser according to claim 1, wherein said inner open mouth end is approximately at the longitudinal axis of the housing.

3. The dispenser according to claims 1 or 2, wherein said folding-bellows cover is formed such that upon bellows operation during the compressing of said folding-bellows cover, the tubule tips substantially into a coaxially position relative to the longitudinal axis of the housing with said dispenser-outlet opening and said inner open mouth substantially coaxially to said longitudinal axis.

4. The dispenser according to claim 1, wherein said tubule is formed such that the piston retracts upon the release of the bellows before the pasty substance in the tubule can reach the inner open mouth end.

5. The dispenser according to claim 1, wherein said tubule is made of a substantially stiff material.

6. The dispenser according to claim 1, wherein said headpiece has a zone formed by a horizontal flat V-shaped constriction extending over substantially half of the cross-sectional width of said headpiece forming the bellows, the headpiece tapering upwardly frustoconically in a normal position.

7. The dispenser according to claim 1, wherein with slow release of the bellows $$\rho V^2/2(64\nu l/Vd^2+1)$$

is at least equal to $$\Delta P_{pf}+\Delta P_{pa}+\Delta P_{sf}+\Delta P_{sa}$$

where $\rho$ is the density of the pasty substance,

V is the average velocity of the pasty substance, $\nu$ is the viscosity of the pasty substance, l (first occurrence) is the length of the tubule, d is the inner open width of the tubule, $\Delta P_{pf}$ is the pressure increment due to piston friction, $\Delta P_{pa}$ is the pressure increment due to piston acceleration, $\Delta P_{sf}$ is the pressure increment due to friction of the pasty substance, and $\Delta P_{sa}$ is the pressure increment due to acceleration of the pasty substance.

8. The dispenser according to claim 1, wherein said tubule is non-displaceable relative to said headpiece.

9. The dispenser according to claim 1, wherein said inner section of the tubule projects beyond the bellows with said innermost end thereof.

10. The dispenser according to claim 1, wherein said tubule has a substantially linear axis.

11. The dispenser according to claim 10, wherein said tubule has a substantially uniform cross-section.

12. The dispenser according to claim 1, wherein said folding-bellows cover has a highest surface constituting pressing surface extending from and substantially on one side of said tubule in a direction substantially away from the direction of extension of said tubule towards said outer end of the tubule.

13. The dispenser according to claim 12, wherein said tubule is mounted in said folding-bellows cover at a position spaced away from the longitudinal axis of said tubular housing in substantially the same direction as the direction of extension of said tubule towards said outer end of the tubule which extends away from said longitudinal axis, whereby said longitudinal axis intersects said pressing surface and the latter surrounds and extends beyond said longitudinal axis.

14. The dispenser according to claim 13, wherein said tubule projects above said folding-bellows cover to said outer end of the tubule, said outer end being located substantially above a side of said tubular housing.

15. The dispenser according to claim 1, wherein said acute angle is substantially 45°.

* * * * *